US006792868B2

(12) United States Patent
Teilhol et al.

(10) Patent No.: US 6,792,868 B2
(45) Date of Patent: Sep. 21, 2004

(54) LOCK FOR IGNITER PLUG LEVER

(75) Inventors: Frédéric Teilhol, Villefrance-de-Lauragais (FR); Guy Valembois, Blagnac (FR); Régis Riffet, Roquettes (FR); Jean Baricos, Ramonville-Saint-Agne (FR)

(73) Assignee: Etienne Lacroix Tous Artifices S.A., Muret (FR)

( * ) Notice: Subject to any disclaimer, the term of this patent is extended or adjusted under 35 U.S.C. 154(b) by 0 days.

(21) Appl. No.: 10/240,957

(22) PCT Filed: Apr. 5, 2001

(86) PCT No.: PCT/FR01/01028

§ 371 (c)(1),
(2), (4) Date: May 6, 2003

(87) PCT Pub. No.: WO01/77608

PCT Pub. Date: Oct. 18, 2001

(65) Prior Publication Data

US 2003/0167953 A1 Sep. 11, 2003

(30) Foreign Application Priority Data

Apr. 6, 2000 (FR) ..... 00 04401
Jul. 31, 2000 (FR) ..... 00 10059

(51) Int. Cl.[7] ..... F42B 27/00
(52) U.S. Cl. ..... 102/487; 102/482
(58) Field of Search ..... 102/487, 482, 102/486

(56) References Cited

U.S. PATENT DOCUMENTS 2,437,001 A * 3/1948 Petersen ..... 102/487
3,498,223 A * 3/1970 Anderson et al. ..... 102/221
3,765,337 A * 10/1973 Padula ..... 102/487
3,823,669 A * 7/1974 Zacharin ..... 102/487
4,513,667 A 4/1985 Caruso
4,926,750 A * 5/1990 Van Sloun ..... 102/261
4,926,752 A * 5/1990 DiRubbio et al. ..... 102/486
5,355,803 A * 10/1994 Robinet et al. ..... 102/487

FOREIGN PATENT DOCUMENTS

| | | |
|---|---|---|
| DE | 1129090 B | 5/1962 |
| FR | 628604 A | 10/1927 |
| FR | 2432153 | 2/1980 |
| FR | 2686688 | 7/1993 |

* cited by examiner

*Primary Examiner*—Charles T. Jordan
*Assistant Examiner*—Bret Hayes
(74) *Attorney, Agent, or Firm*—Blakely, Sokoloff Taylor & Zafman

(57) ABSTRACT

The invention concerns an igniter plug for a pyrotechnic device, in particular a hand-launch or mechanical launch grenade, comprising a body (104) provided with a control mechanism including a fly-off lever (101) and a percussion mechanism (128) co-operating with a primary pyrotechnic module (105) for initiating the charge (119) of the associated device. The invention is characterised in that it further comprises a lock (150) engaged with the lever (101), in storage position, to prevent the fly-off lever (101) from moving towards its release position, the lock (150) being configured to impose, when the igniter plug is activated, an initial movement of the lever (101) countering its displacement required for releasing the percussion mechanism (128), so as to disengage the lock (150) and the fly-off lever (101).

35 Claims, 11 Drawing Sheets

101
F1
128
103
122
102
150
105
117
119

LOCK FOR IGNITER PLUG LEVER

The present patent application is a non-provisional application of International Application No. PCT FR01/01028, filed Apr. 5, 2001.

The present invention relates to the field of ignitor plugs for pyrotechnical devices.

The present invention is particularly, but not exclusively, applicable to grenades for hand launching or for use with mechanical launch means, and regardless of the function of such grenades, be they explosive, smoke-generating, illuminating, or a combination thereof.

Numerous documents relating to ignitor plugs have already been published.

Reference can be made for example, to documents FR-A-2 338 478, FR-A-2 354 506, and FR-A-2 428 233.

Document FR-A-2 686 688 describes a delay ignitor plug for a pyrotechnical device as shown in accompanying FIG. 1 that comprises a body 4 fitted with a control mechanism comprising a trigger lever 1 and a percussion mechanism 28 co-operating with a primary pyrotechnical module 5, 3, 9, 13 suitable for initiating the charge 19 of the associated device and axially displaceable in the body towards the main charge, means 2 for holding the primary pyrotechnical module 5 axially spaced apart from the main charge 19, and a screen 12*a*, 15 interposed between the main charge and the primary pyrotechnical module.

More precisely, in document FR-A-2 686 688, the means 2 for holding the primary pyrotechnical module 5 spaced axially apart from the main charge 19 are means that are purely mechanical, being actuated by the trigger lever 1.

Still more precisely, in document FR-A-2 686 688, the means for holding the pyrotechnical module 5 spaced axially apart from the main charge 19 comprise a clip 2 housed in the body 4 of the plug and engaged with the primary pyrotechnical module 5, the trigger lever 1 having a member 1*a* for extracting the clip during release of the trigger lever 1 relative to the body of said plug.

That known device shown in FIG. 1 operates essentially as follows.

To initiate the system, a pin 25 is extracted from the grenade by a, combined twist and pull action. The grenade is then thrown. Since the trigger lever 1 is no longer held in its locked position, elastic force from a spring 22 acts via a striker 24 to pivot the lever 1. After turning through about 30°, the finger 1*a* of the trigger lever 1 presses against the clip 2 and begins to extract it. During the next stage of lever pivoting, the striker 24 escapes and strikes the cap 3, the clip 2 still not being released from the delay primary pyrotechnical module 5. By inertia, the trigger lever 1 terminates its pivoting and releases itself from the body 4, taking the clip 2 with it, thereby unlocking the delay primary pyrotechnical module 5. Since this module is still subjected to the thrust from the striker 24 in association with the spring 22, the delay primary pyrotechnical module 5 is moved in translation, thus displacing the screen 12*a*, so that the solid element 12*a* of a cup 12 comes to the bottom of a cell 29 in a cup 18. A microdetonator 13 is then in position to initiate detonation by a radial effect.

An object of the present invention is to provide a novel, improved ignitor plug.

This object is achieved in a first aspect of the present invention by an ignitor plug for a pyrotechnical device, in particular a grenade for hand or mechanical launching, the device comprising a body fitted with a control mechanism comprising a trigger lever and a percussion mechanism co-operating with a primary pyrotechnical module for initiating the charge of the associated device, the plug being characterized by the fact that it further comprises a latch which engages the lever in the storage position to prevent free displacement of the trigger lever towards its release position, the latch being so shaped that during initial operation of the ignitor plug it requires the lever to be moved initially in the opposite direction to that required for releasing the percussion mechanism in order to disengage the latch from the trigger lever.

The person skilled in the art will understand that the structure as proposed in this way makes it possible to guarantee that the device is entirely reliable by preventing any non-authorized untimely firing.

According to an advantageous characteristic of the present invention, the latch is urged resiliently towards a release position where it is disengaged from the lever.

According to another advantageous characteristic of the present invention, the latch is itself held initially in an initial safe position by at least two mechanical blocking means, such that release of the latch requires both of these blocking means to be manipulated.

According to another advantageous characteristic of the present invention, one of the latch blocking means is formed by the trigger lever.

According to another advantageous characteristic of the present invention, one of the latch blocking means is formed by a pin.

According to another advantageous characteristic of the present invention, the primary pyrotechnical module is axially displaceable inside the body towards the main charge, and mechanical means hold the primary pyrotechnical module spaced axially away from the main charge in an initial, safe position, the plug being characterized in that the means for holding the primary pyrotechnical module axially apart from the main charge comprise the latch urged resiliently away from an initial, safe position in which the latch interferes with the travel path of the primary pyrotechnical module to prevent it from moving towards the main charge, towards a release position in which the latch lies off the travel path of the primary pyrotechnical module.

The above-specified object is achieved in a second aspect of the present invention by an ignitor plug for a pyrotechnical device, in particular a grenade for hand or mechanical launching, the device comprising a body fitted with a control mechanism comprising a trigger lever and a percussion mechanism co-operating with a primary pyrotechnical module for initiating the charge of the associated device and axially displaceable inside the body towards the main charge, and mechanical means for holding the primary pyrotechnical module spaced axially away from the main charge in an initial, safe position, characterized in that the means for holding the primary pyrotechnical module axially apart from the main charge comprise the latch urged resiliently away from an initial, safe position in which the latch interferes with the travel path of the primary pyrotechnical module to prevent it from moving towards the main charge, towards a release position in which the latch lies off the travel path of the primary pyrotechnical module, the latch being itself initially held in an initial, safe position by at least two mechanical blocking means such that release of the latch requires both of the blocking means to be manipulated.

According to an advantageous characteristic of the invention, the means for holding the primary pyrotechnical module axially spaced apart from the main charge further comprise a clip received in the body of the plug and initially engaged with the primary pyrotechnical module, the clip being provided with means suitable for co-operating with the trigger lever to act during release of the trigger lever to cause the clip to be extracted from the body of said plug.

Other characteristics, objects, and advantages of the present invention appear on reading the following description and from the accompanying drawings given as non-limiting examples and in which:

FIG. 1, described above, shows a known ignitor plug in accordance with the state of the art as illustrated in document FR-A-2 686 688;

The ignitor plug shown in the accompanying figures is particularly suitable for hand grenades. Nevertheless, it is not limited to this particular application.

In the accompanying figures, there can be seen a support body 104. The body may be made of a fiberglass-filled plastics material, of a light alloy, or of any other equivalent material.

The body 104 carries a primary pyrotechnical module 105 and a secondary pyrotechnical module 117. The secondary module 117 is preferably fixed to the body 104, while the primary pyrotechnical module 105 is capable of moving in translation along an axis O—O between an initial, safe position (shown in FIG. 2) and a subsequent, working position (shown in FIG. 7), as explained below.

Figure 1:
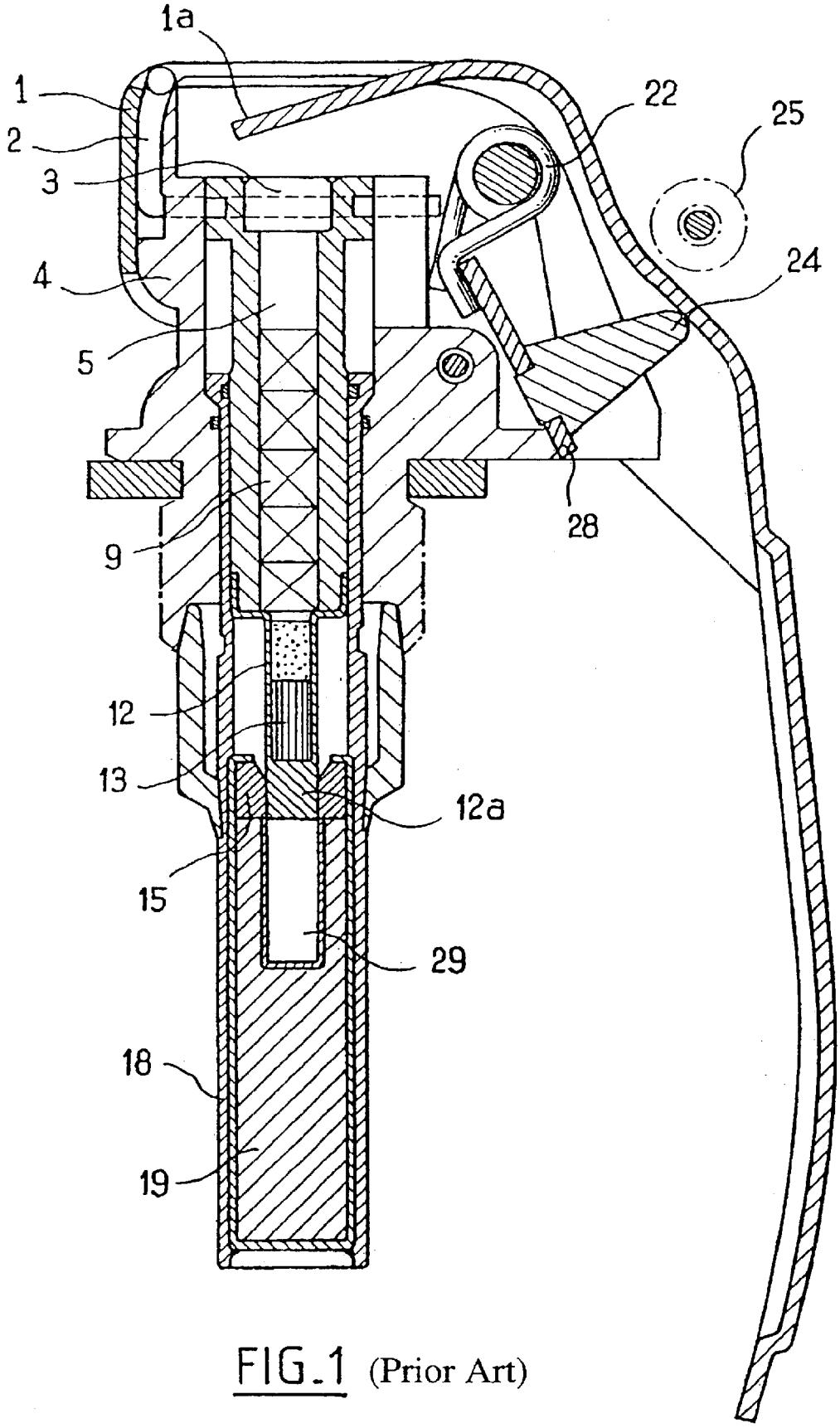
FIG.1 (Prior Art)
Figure 2:
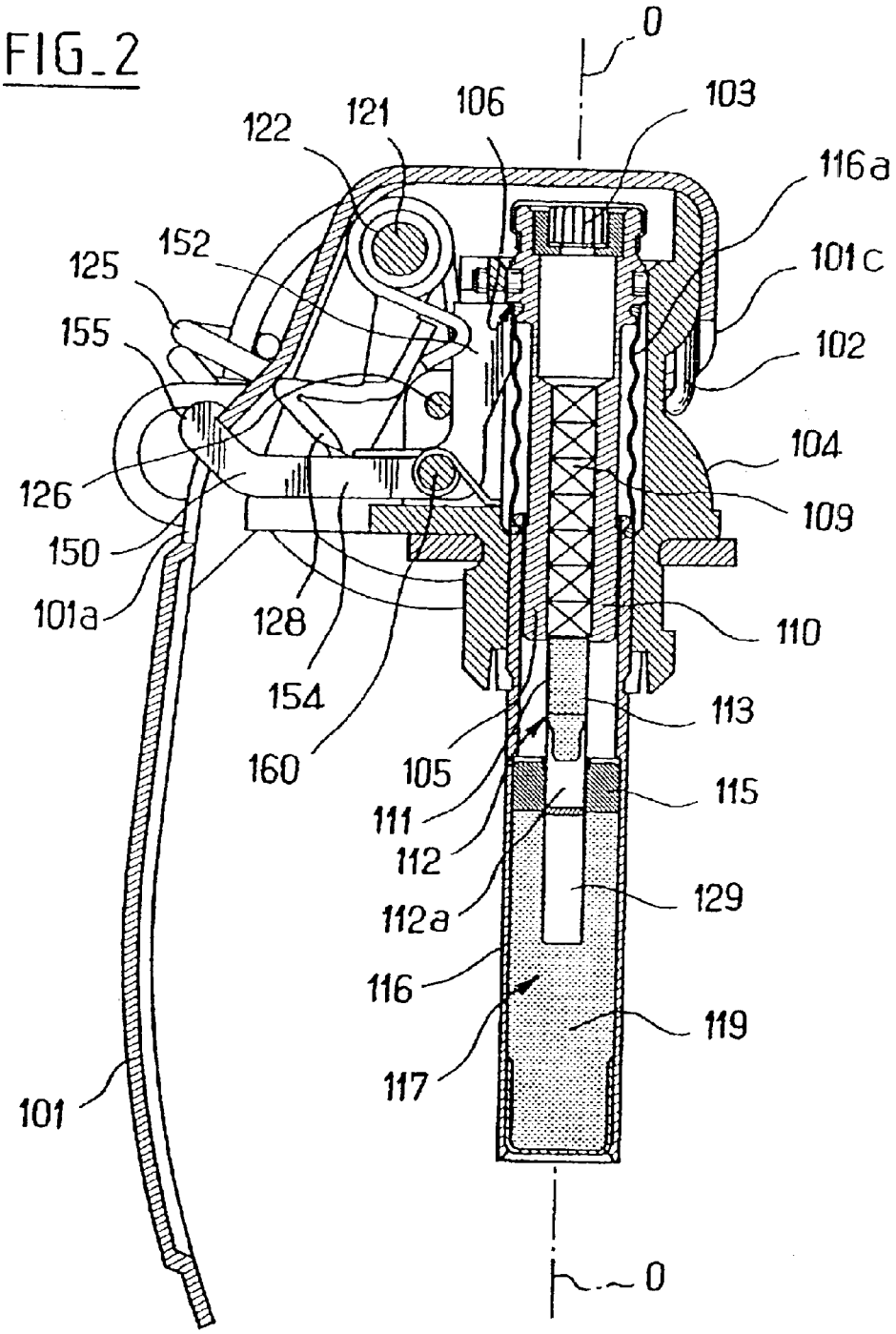
FIG. 2 is a diagram showing the structure of an ignitor plug in accordance with the present invention in its initial, safe position.

In conventional manner, the device shown in FIG. 2 et seq. further comprises a trigger lever 101 having a transverse locking pin 125 fitted with a pull ring.

The ignitor plug shown in FIG. 2 et seq. also has a striker device 128 mounted to pivot on the body 104 about an axis 121 extending transversely to the axial O—O of relative translation defined between the primary pyrotechnical module 105 and the secondary pyrotechnical module 117. The striker 128 is urged towards a position for striking the primary pyrotechnical module 105 by a spring 122, e.g. wound around the transverse axis 121. Nevertheless, the striker 128 is initially held away from the primary pyrotechnical module 105 by the trigger lever 101.

As described in document FR-A-2 686 688, the primary pyrotechnical module 105 is preferably initially held away from the secondary pyrotechnical module 117 by a clip 102.

The clip 102 has a main branch extending transversely to the axis O—O and thus acting, in the initial, storage position, to interfere both with the body 104 and with the primary pyrotechnical module 105.

The lever 101 is engaged by means of a front nose 101*c* in a step of the body 104. The body 104 preferably also has two curved side ramps (not shown in the accompanying figures to simplify the drawings) arranged beneath the lever 101 in such a manner as to guide its pivoting after the pin 125 has been removed.

The primary pyrotechnical module 105 is preferably a delay module. It comprises a metal case 110, e.g. made of light alloy, having a cup 112 crimped to its base, the length and the diameter of the cup corresponding to the length and the diameter of an axial chamber 129 formed in the secondary pyrotechnical module 117. The primary pyrotechnical module carries at least one delay element 109.

At its top end, the metal case 110 carries a percussion cap 103 which is held in place by crimping, for example, and which is protected by varnish or by resin. The position of the percussion cap 103 on the metal case 105 and the amplitude of the striker 128 are determined in such a manner that when the trigger lever 101 is withdrawn, the striker 128 strikes the cap 103 under drive from the spring 122.

Between the percussion cap 103 and the cup 112, the metal case 110 houses in succession along the axis O—O and starting from the percussion cap 103: a delay composition 109; an initiator composition 111; and a microdetonator 113 which constitutes the primary explosive of the explosive chain.

The base of the cup 112 is secured to a metal pellet 112*a*.

The case 110 of the primary pyrotechnical module 105 is inserted in part in a case 116 of the secondary pyrotechnical module 117. Nevertheless, an axial space allows the case 110 to slide inside the case 116 along the axis O—O when the case 110 is released.

Sealing means are preferably interposed between the case 110 of the primary pyrotechnical module 105 and the case 116 of the secondary pyrotechnical module 117. In the particular and non-limiting embodiment shown in the accompanying figures, these sealing means are constituted by a flexible sheath referenced 116*a* having its ends fixed respectively to the case 110 in the vicinity of the percussion cap 103 and to the case 116.

The secondary pyrotechnical module 117 preferably includes a detonation relay constituted by an aluminum cup containing a secondary explosive 119 and a closure ring or capsule 115 which, in combination with the pellet 112*a* disposed in the bottom of the cup 112 of the primary module 105, forms a screen between the microdetonator 113 and the secondary explosive 119 which constitutes the main initiator charge. For this purpose, and as can be seen in accompanying FIG. 2, in the initial safety position for storage purposes, the pellet 112*a* is situated level with the closure cap 115 in a bore formed therein.

There follows a description of the particular means proposed in the context of the present invention for improving the safety of the above-described ignitor plug.

As mentioned above, the means of the invention for holding the primary pyrotechnical module 105 in a position that is axially spaced apart from the main charge 119 essentially comprise a latch 150.

Figure 5:
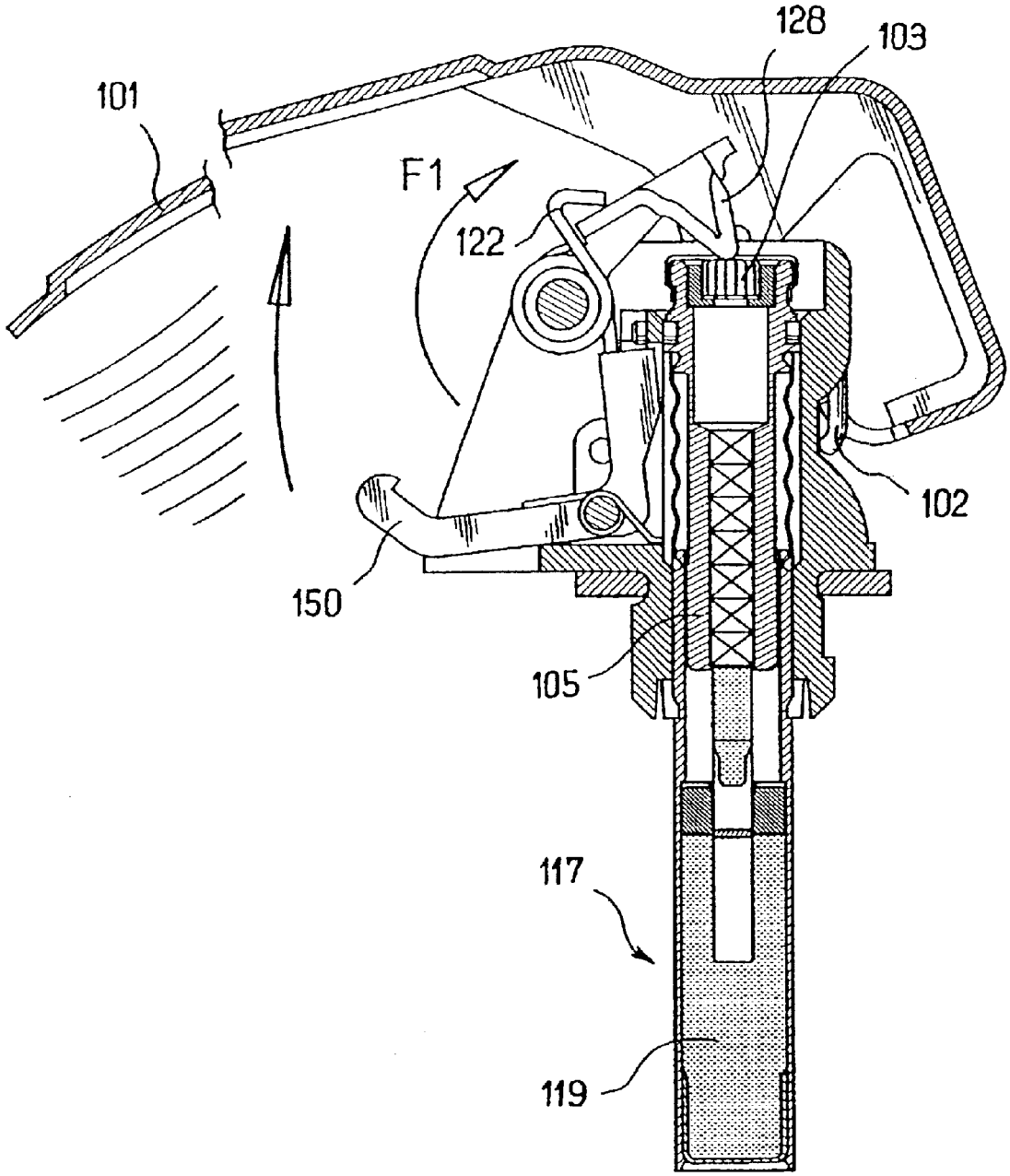

The latch 150 is urged resiliently away from an initial safe position shown in FIG. 2 towards a release position shown in FIG. 5.

In the initial, safe position, the latch 150 interferes with the displacement path of the primary pyrotechnical module 105 to prevent it from moving towards the main charge 119.

In contrast, when the latch 150 is in its released position it is remote from the displacement path of the primary pyrotechnical module 105.

Furthermore, in the context of the invention, the latch 150 is itself initially held in the initial, safe position as shown in FIG. 2 by at least two mechanical blocking means.

Thus, releasing the latch 150 requires both of these blocking means to be manipulated.

Still more precisely, as can be seen in the accompanying figures, in the context of the present invention, the two mechanical blocking means for the latch 150 are preferably constituted firstly by the trigger lever 101, and secondly by the pin 125.

Still more precisely, in the particular embodiment shown in the accompanying figures, the latch 150 is generally L-shaped having two main branches 152 and 154 that extend generally orthogonally to each other.

The latch 150 is mounted to pivot between its initial, safe position and its release position about an axis 160 situated in the vicinity of the intersection between its two branches 152 and 154.

The axis of rotation of the lever 150 may be embodied by an axle engaged both in the body 104 and the lever 150, or by any equivalent means.

The resilient member urging the latch 150 towards its release position away from its initial, safe position is preferably formed by a kickover spring 170 having a spiral wound around the axis 160 and two end branches bearing respectively against the body 104 and against the latch 150.

In the initial, safe position, one of the branches 152 of the latch 150 extends substantially parallel to the translation axis O—O of the primary pyrotechnical module 105. The branch 152 extends towards the end of the primary pyrotechnical module 105 that is adjacent to the cap 103, starting from the axis of rotation 160. As can be seen in accompanying FIG. 2, in the initial, safe position, the free end of this branch 152 serves as an abutment for a notch 106 formed in the case 110 of the primary pyrotechnical module 105.

Thus, in the initial, safe position, the latch 150 prevents the case 110 from moving towards the main charge 119.

The second branch 154 of the latch 150, in the initial position, extends substantially transversely to the translation axis O—O of the case 110; going away from said axis O—O starting from the axis of rotation 160.

Furthermore, as can be seen in the accompanying figures, the free end of the second branch 154 of the latch 150 is preferably provided with a catch 155 passing through a passage 101*a* formed in the trigger lever 101 so that the catch 155 engages the outside surface of the trigger lever 101 in the initial, safe position.

The direction in which the contact surfaces defined in this way between the catch 155 and the trigger lever 101 extend, and the surface state of the contact zones, are defined in such a manner that the torque that results from the friction force exerted on the catch 155 of the latch 150 by the trigger lever 101 is greater than the torque applied to the latch 150 by the spring 170. Thus, the co-operation defined between the trigger lever 101 and the latch 150 prevents the latch 150 from moving towards its release position under drive from the spring 170 so long as the trigger lever 101 has not been moved towards the axis O—O of the device, thereby releasing the catch 155 and the latch 150, as explained below.

As shown in the accompanying figures, it should also be observed that in the initial, safe position, one of the branches 126 of the pin 125 acts as a bearing surface for the branch 152 of the latch 150, said branch 126 extending transversely to the axis O—O. Still more precisely, the branch 126 of the pin 125 serves as a bearing surface for the radially outer surface of the branch 152.

The device in accordance with the present invention as shown in accompanying FIG. 2 et seq. operates essentially as follows.

In the initial, safe position, the striker 128 is prevented from moving by the trigger lever 101. The trigger lever is itself prevented from moving by the pin 125. The latch 150 is held in the safe position firstly by the trigger lever 101 acting via the catch 155, and secondly by the branch 126 of the safety pin. The case 110 of the primary pyrotechnical module 105 is held in its position remote from the secondary pyrotechnical module 117 firstly by the latch 150 and secondly by the clip 102.

Figure 3:
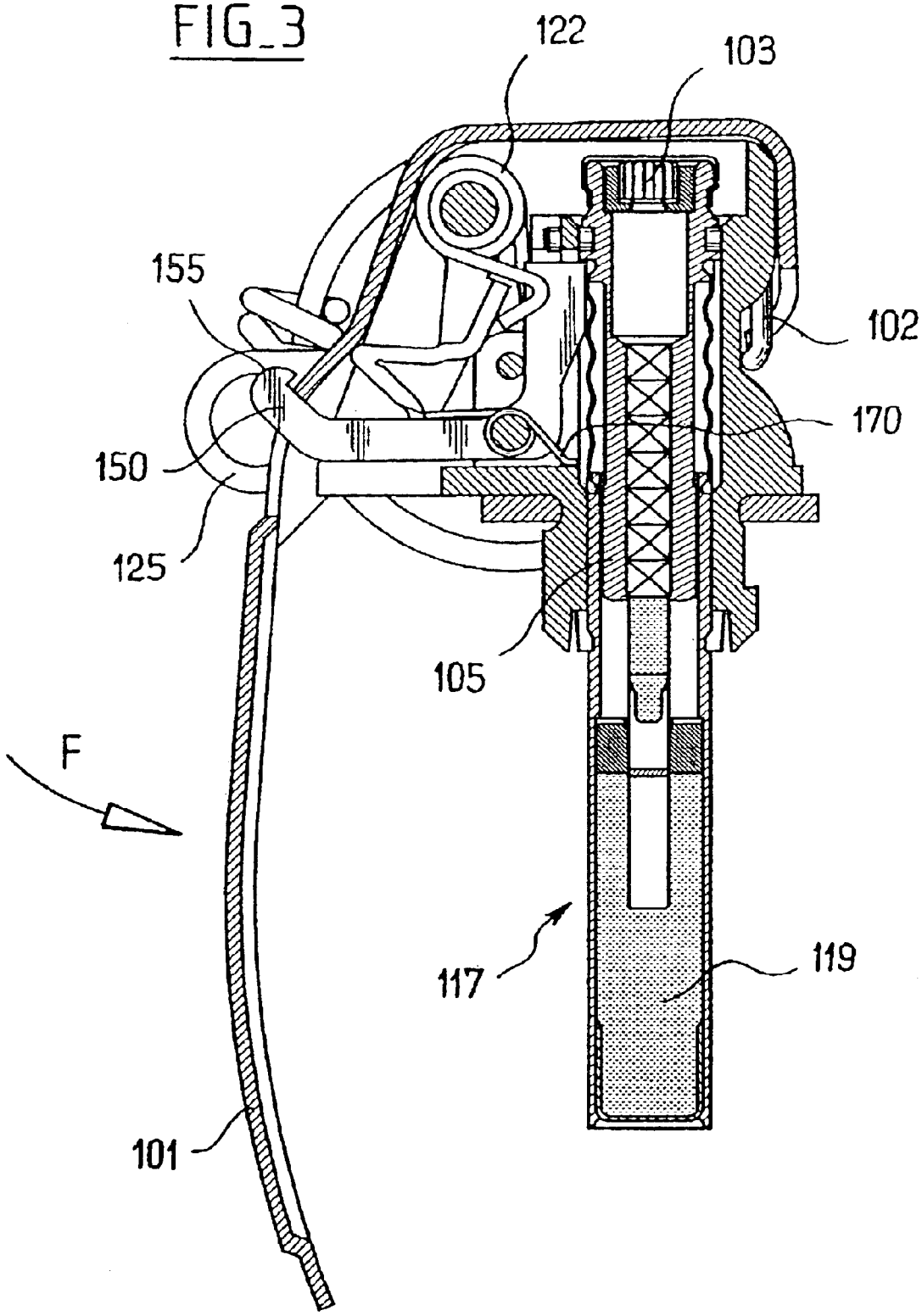
FIGS. 3 to 7 show the same device in various successive stages of its operation.

In order to operate the ignitor plug of the present invention as shown in FIG. 2 et seq., it is necessary initially to press the trigger lever 101 down against the body of the device as represented in FIG. 3 by the arrow referenced F, and as can be seen by comparing FIGS. 2 and 3.

As shown in FIG. 3, moving the trigger lever 101 in this way releases clearance between the catch 155 of the latch 150 and the trigger lever 101.

Figure 4:
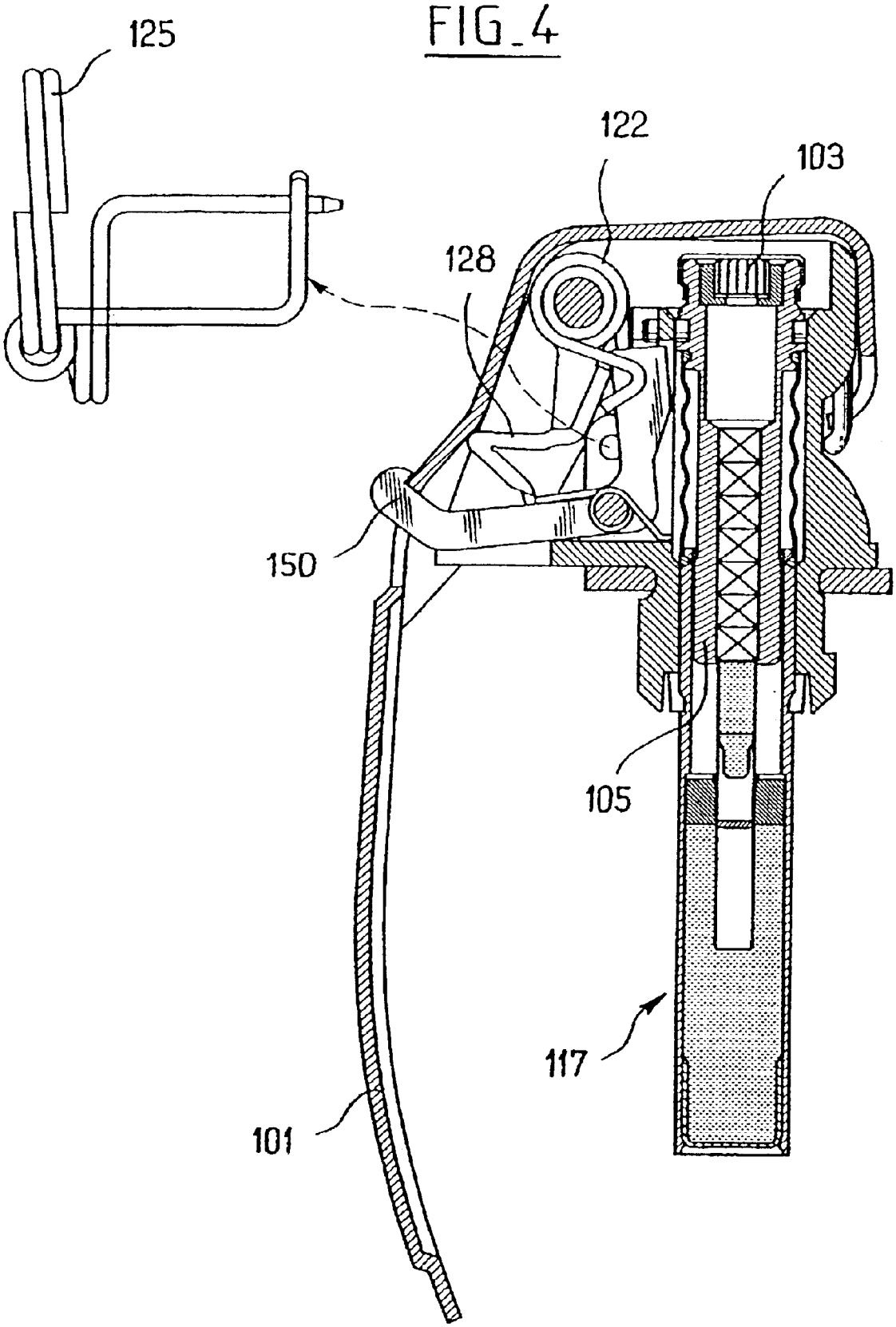

It is then necessary to extract the safety pin 125 are represented in FIG. 4, e.g. by using the conventional "twist-and-pull" functions specific to this kind of pin.

As can be seen in FIG. 4, since the latch 150 has previously been released from co-operating with the trigger lever 101, extracting the branch 126 of the pin 125 releases the latch 150 completely, thus allowing it to turn about its axis 160 under drive from the spring 170.

The primary pyrotechnical module 105 is then released from the latch 150, as shown in FIG. 4.

For a device that is to be thrown by hand, the device is then ready to be thrown in conventional manner.

Under the effect of the loaded spring 122, the striker 128 causes the released module 101 to rotate. The striker 128 loses contact with the lever 101 and strikes the cap 103, thereby firing the delay 109 after traveling over a free stroke of about 65°, for example, which angle is greater than the angle needed for initiating the cap (as shown in FIG. 5).

Figure 6:
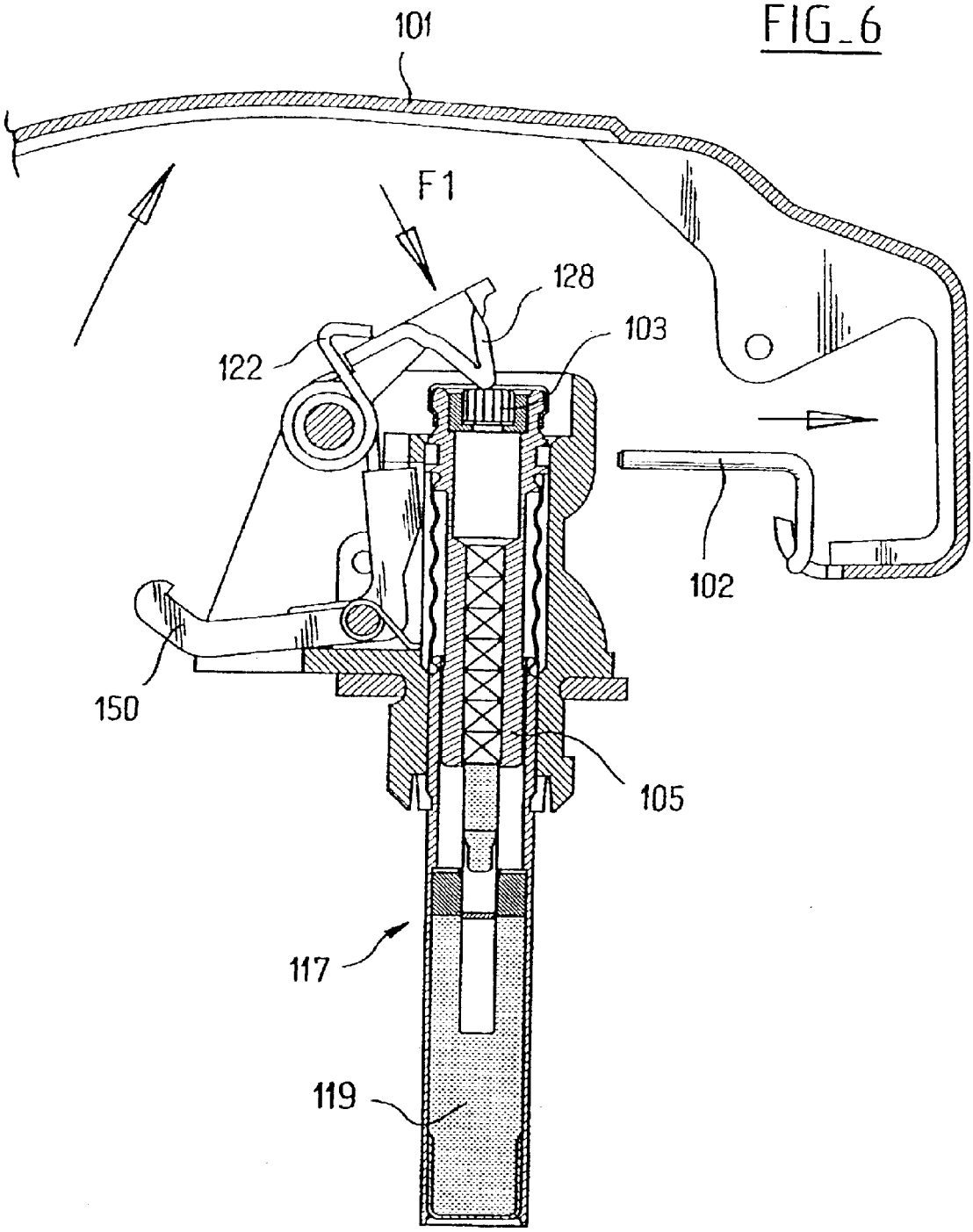

As shown in FIG. 6, the trigger lever 101 then terminates its rotation and extracts the locking clip 102. Typically the locking clip 102 is extracted about $5/100^{ths}$ of a second after the cap 103 has been struck. This disposition implements a safety feature for protecting the user of the device in the event of the primary module functioning instantaneously.

The cap 110 of the primary pyrotechnical module 105 is thus released to move in translation along the axis O—O because the clip 102 has been ejected.

The residual force of the striker 128 on the case 110 enables the case to move in translation towards the secondary pyrotechnical module 117 and to align the explosive chain by positioning the microdetonator 113 in the core of the detonation relay of the secondary pyrotechnical module 117.

When the delay 109 comes to the end of its combustion, it excites the primary microdetonator 103 which in turn initiates the detonation relay 119.

Figure 7:
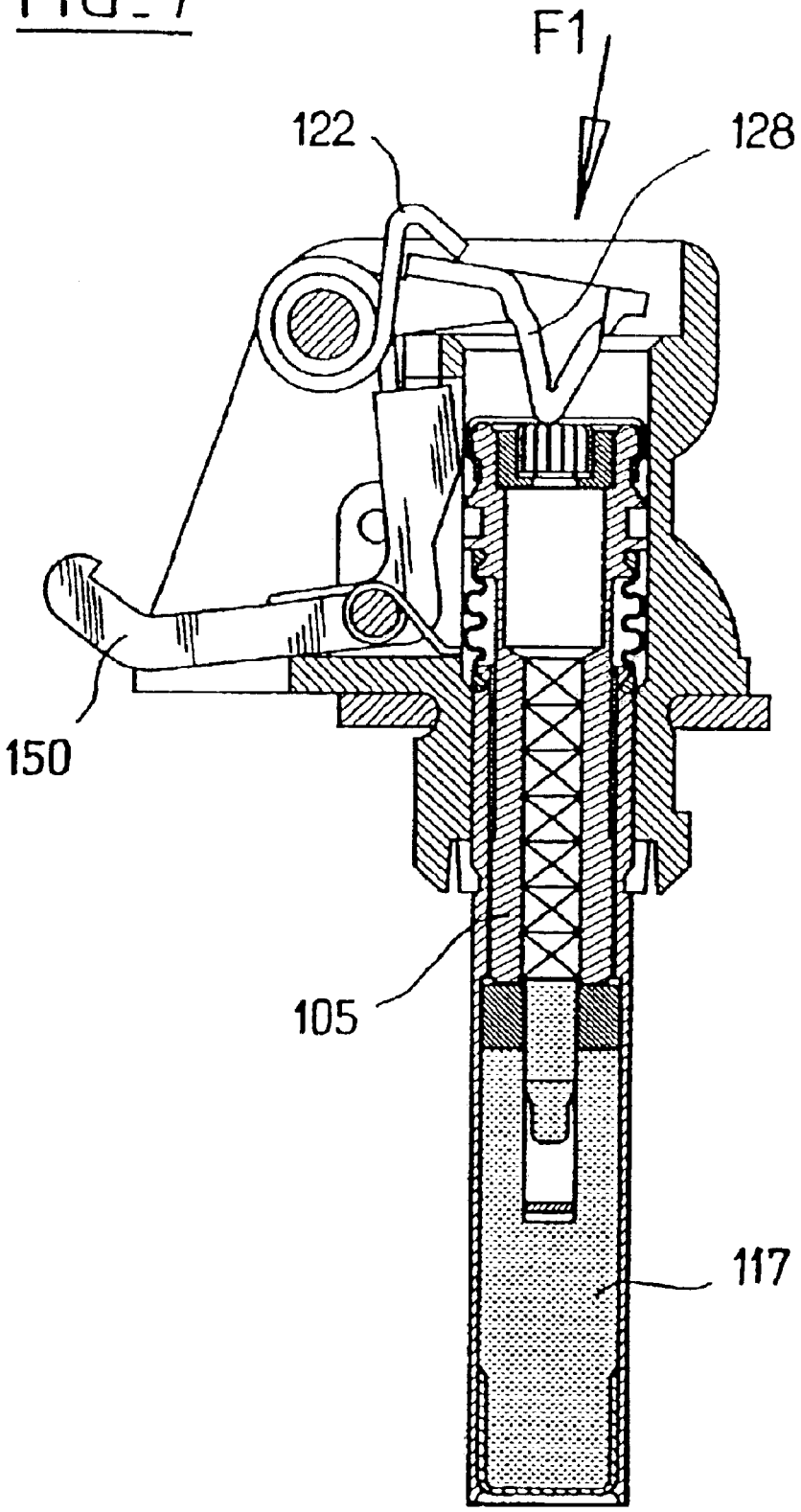

At the moment of firing, the device is in the position shown in FIG. 7.

Figure 8:
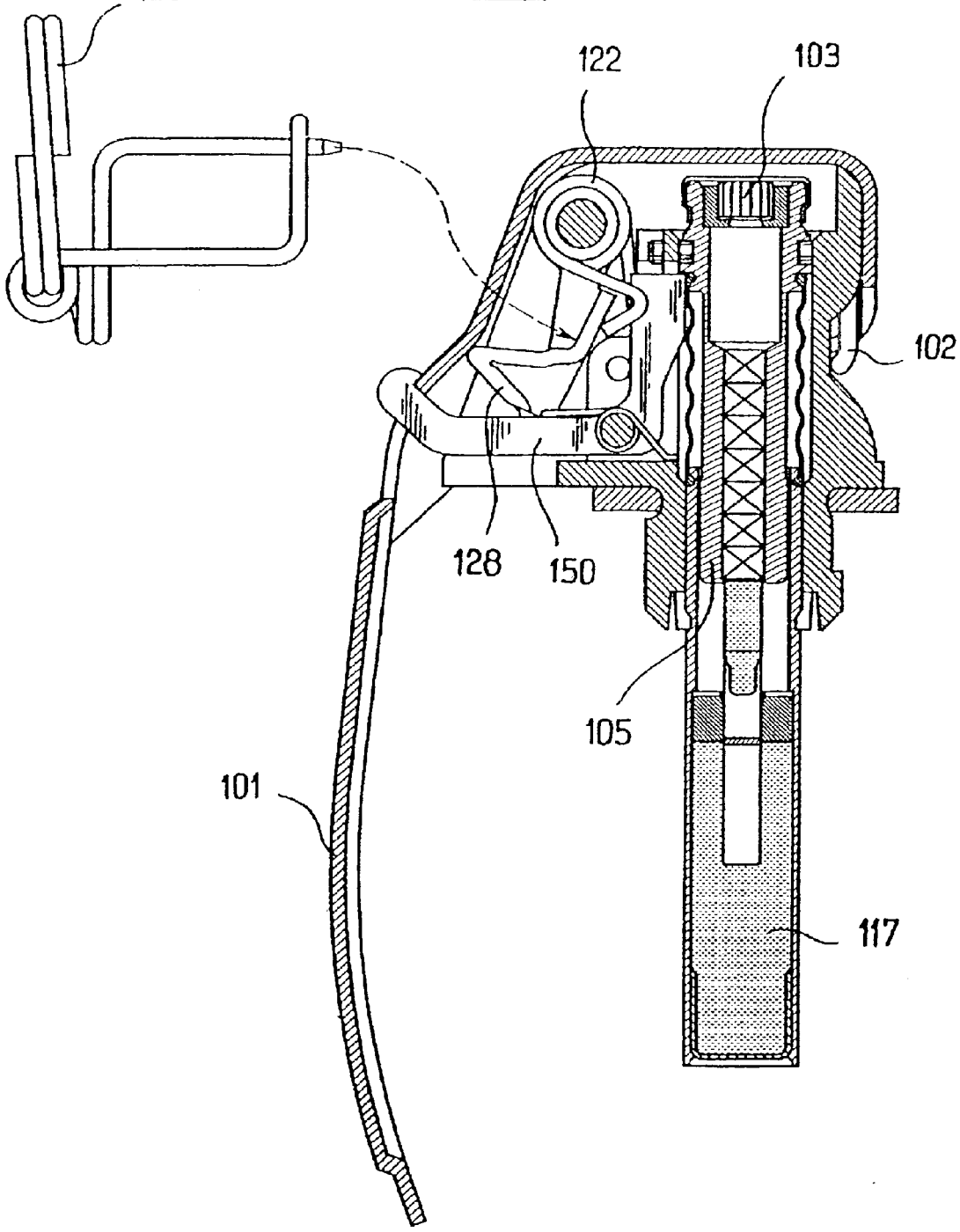
FIGS. 8 and 9 show the same device in two circumstances of non-operation resulting from safety means incorporated in the device, and following use in a manner that does not comply with the required protocol.
Figure 9:
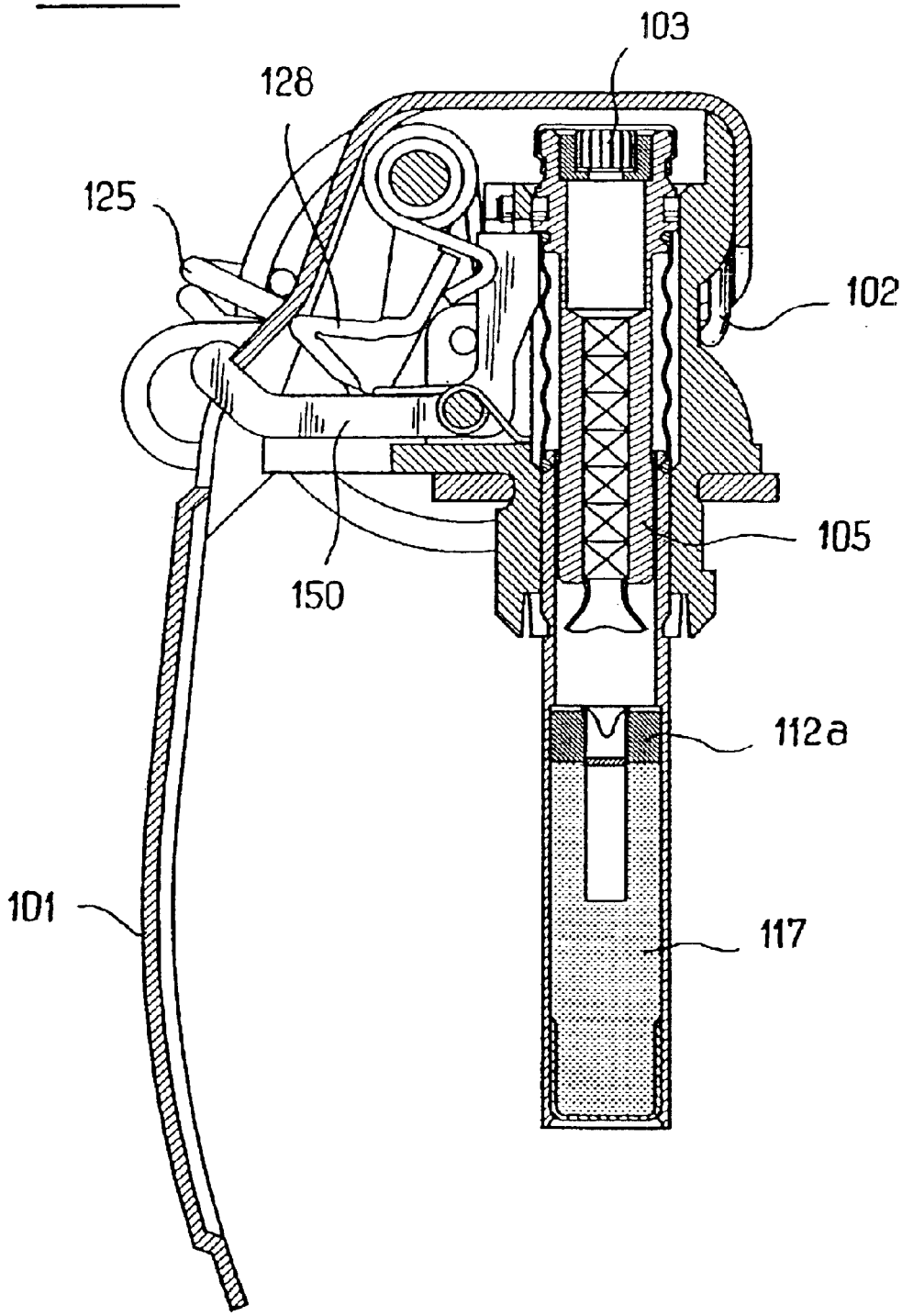

Nevertheless, it should be observed that as shown in FIG. 8, if the device is wrongly manipulated, for example by extracting the pin 125 without holding the trigger lever 101 down, then the latch 150 remains blocked by the trigger lever 101 so the latch 150 prevents the primary pyrotechnical module 105 from moving.

Similarly, if the trigger lever 101 is pressed down without the pin 125 being removed, then the device returns to its position shown in FIG. 3, the pin holding the latch 150 in its initial, safe position, and the primary pyrotechnical module 105 remaining in its initial, locked position.

Furthermore, if for any reason whatsoever the primary pyrotechnical module 105 were to be excited while in its storage position, as shown in FIG. 2, then the consequence of initiating the microdetonator 113 would be to crimp the solid portion of the microdetonator support formed by the cup 112 in the ring 115 of the detonation relay. Typically, this produces a disk having a thickness of about 4 millimeters (mm) which isolates the primary portion or microdetonator 113 from the secondary portion or detonation relay, thus preventing it from being initiated. The solid disk thus constitutes a physical break in the explosive chain, providing safety in storage.

Naturally, the present invention is not limited to the particular embodiments described above, but extends to any variant within the spirit of the invention.

In particular, as described below with reference to FIGS. 10 to 12, the device of the present invention may be fitted with additional means suitable for preventing it from operating in the event of the pin 125 being removed without the trigger lever 101 being held down.

Figure 10:
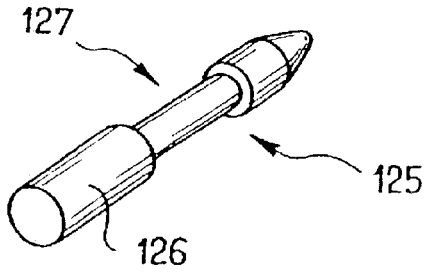
FIG. 10 is a diagram of a pin constituting a variant embodiment of the present invention.

In a first variant as shown in FIG. 10, the additional safety means provided for this purpose comprise means for preventing the pin 125 from being ejected unless the trigger lever 101 is held down. Still more precisely, in the variant shown in FIG. 10, these means are constituted by a setback 127 formed in the branch 126 of the pin 125 so that in the rest position the pin 125 can be offset relative to the trigger lever 101.

Thus, if the user attempts to pull out the pin 125 before pressing down the trigger lever 101, then the setback 127 comes into abutment against the lever 101 thus preventing the pin 125 from being extracted.

In contrast, when the trigger lever 101 is initially pressed down against the body of the device, as shown in FIG. 3, then the pin is in alignment with the bore through the trigger lever 101 so it is possible to extract the pin 125.

Two other additional means are intended specifically to prevent untimely operation of the device in the event of it being dropped accidentally after the pin 125 has been extracted without the lever being held down.

Figure 11:
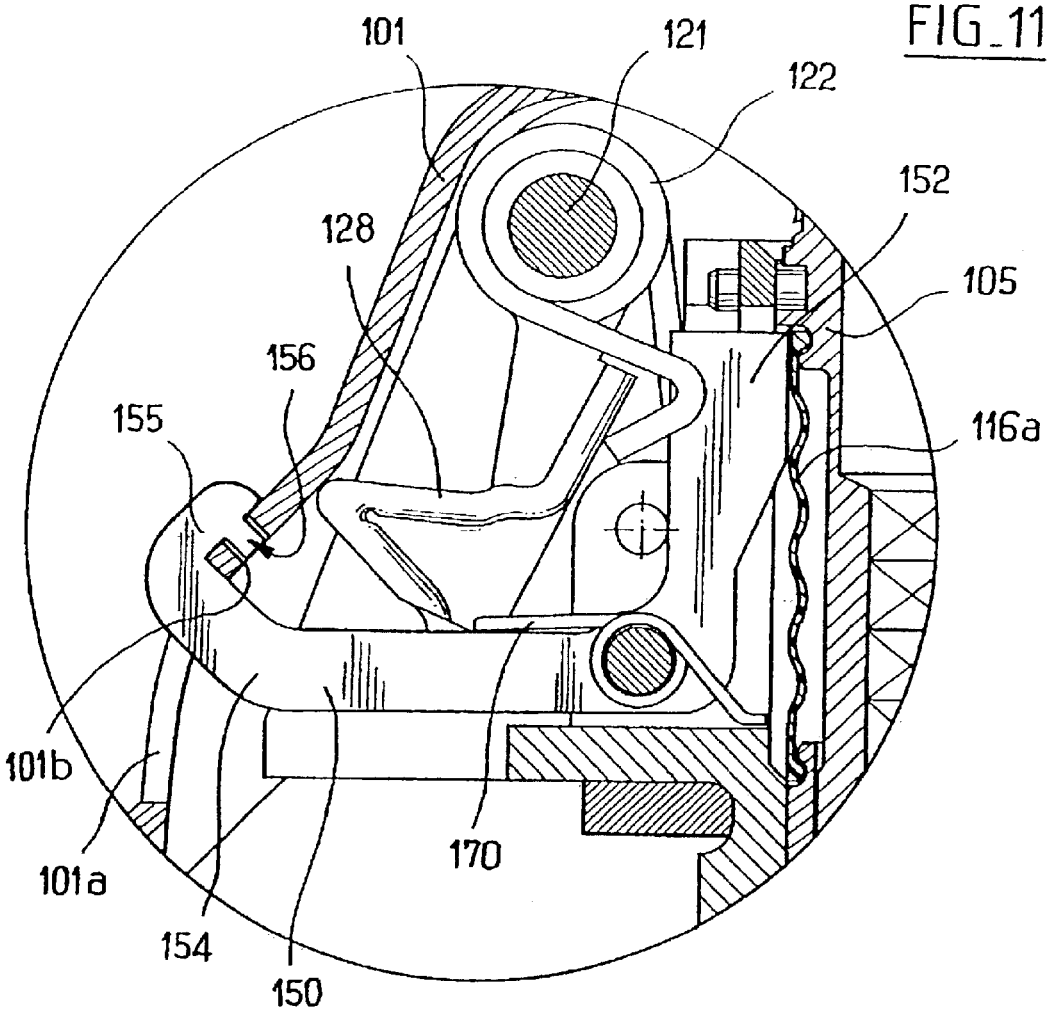
FIG. 11 is a diagram showing means for defined co-operation between the latch and the trigger lever in accordance with a variant embodiment of the present invention.

In the variant shown in FIG. 11, one of these means is constituted by complementary shapes between the catch 155 of the latch 150 and the trigger lever 101. Still more precisely, and as shown in FIG. 11, the catch 155 possesses a stud 156 or the equivalent extending generally radially inwards towards the axis O—O and suitable for penetrating into a complementary bore 101*b* formed in the trigger lever 101.

Thus, in the variant shown in FIG. 11, even in the event of the pin 125 being withdrawn, the latch 150 cannot reach its release position so long as the trigger lever is not pressed down against the body of the device so as to enable the stud 156 to escape from the bore 101*b*.

Figure 12:
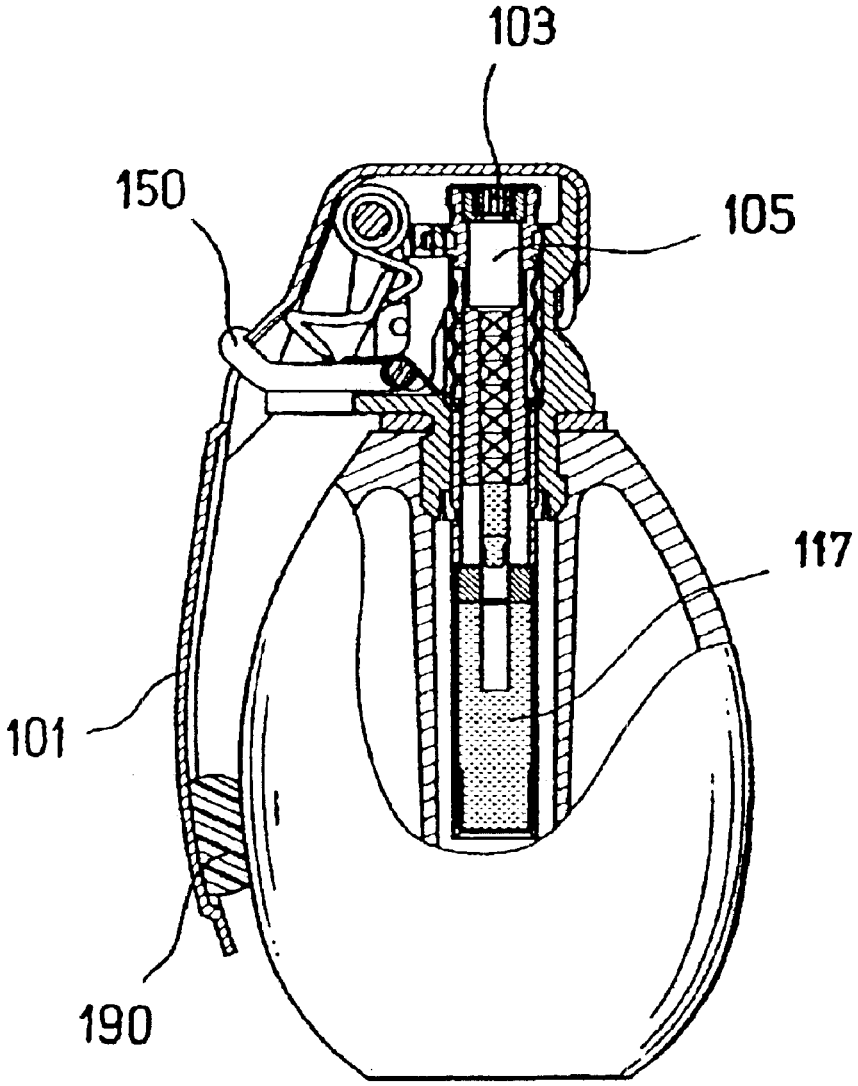
FIG. 12 is a diagram of a device in accordance with an optional variant of the present invention.

In yet another variant embodiment, as shown in FIG. 12, material such as a viscoelastic rubber can be interposed between the trigger lever 101 of the ignitor plug and the body of the device. This material is given overall reference 190 in accompanying FIG. 12. It is preferably constituted by a rubber whose hardness increases with the speed with which force is applied thereto. This makes it possible to avoid the trigger lever 101 moving in the event of it being subjected to a very sharp jolt as results from a fall, while nevertheless allowing the trigger lever 101 to be displaced when the lever 101 is pressed down by hand in conventional manner.

What is claimed is:

1. An ignitor plug for a pyrotechnical device, in particular a grenade for hand or mechanical launching, the device comprising a body (104) fitted with a control mechanism comprising a trigger lever (101) and a percussion mechanism (128) co-operating with a primary pyrotechnical module (105) for initiating a charge (119) of the pyrotechnical device, wherein the plug comprises a latch (150) which engages the lever (101) in a storage position to prevent free displacement of the trigger lever (101) towards a release position, the latch (150) being so shaped that during initial operation of the ignitor plug said latch requires the lever (101) to be moved initially in an opposite direction to that required for releasing the percussion mechanism (128) in order to disengage the latch (150) from the trigger lever (101).

2. The ignitor plug according to claim 1, characterized by the fact that the latch (150) is urged resiliently towards a release position where said latch is disengaged from the lever (101).

3. The ignitor plug according to claim 1, characterized by the fact that the primary pyrotechnical module (105) is axially displaceable inside the body (104) towards a main charge (119), and means (102) hold the primary pyrotechnical module (105) spaced axially away from the main charge (119) in an initial, safe position, the means (102) for holding the primary pyrotechnical module (105) axially apart from the main charge (119) comprising the latch (150) urged resiliently away from an initial, safe position in which the latch (150) interferes with a travel path of the primary pyrotechnical module (105) to prevent it from moving towards the main charge (119), towards a release position in which the latch (150) lies off the travel path of the primary pyrotechnical module (105).

4. The ignitor plug according to claim 1, characterized by the fact that the latch (150) is itself initially held in an initial, safe position by at least two mechanical blocking means (101, 126) such that release of the latch (150) requires both of the blocking means (101, 126) to be manipulated.

5. An ignitor plug for a pyrotechnical device, in particular a grenade for hand or mechanical launching, the device comprising a body (104) fitted with a control mechanism comprising a trigger lever (101) and a percussion mechanism (128) co-operating with a primary pyrotechnical module (105) for initiating a charge (119) of the pyrotechnical device and axially displaceable inside the body (104) towards the charge (119), and means (102) for holding the primary pyrotechnical module (105) spaced axially away from the charge (119) in an initial, safe position, characterized by the fact that the means (102) for holding the primary pyrotechnical module (105) axially apart from the charge (119) comprise a latch (150) urged resiliently away from the initial, safe position in which the latch (150) interferes with a travel path of the primary pyrotechnical module (105) to prevent the primary pyrotechnical module (105) from moving towards the charge (119), towards a release position in which the latch (150) lies off the travel path of the primary pyrotechnical module (105), the latch (150) being initially held in the initial, safe position by at least two mechanical blocking means (101, 126) such that release of the latch (150) requires both of the blocking means (101, 126) to be manipulated.

6. The ignitor plug according to claim 4, characterized by the fact that one of the means for blocking the latch (150) is formed by the trigger lever (101).

7. The ignitor plug according to claim 4, characterized by the fact that one of the means for blocking the trigger lever (101) is formed by a pin (125).

8. The ignitor plug according to claim 1, characterized by the fact that the latch (150) is formed by a pivoting element having a branch (154) in engagement with the trigger lever (101) in the storage position.

9. The ignitor plug according to claim 1, characterized by the fact that the latch (150) is generally L-shaped, having two branches (152, 154), which branches co-operate respectively with the primary pyrotechnical module (105) to serve as an abutment therefore, and with the trigger lever (101).

10. The ignitor plug according to claim 1, characterized by the fact that the latch (150) has a branch (154) passing through a passage (101*a*) formed in the trigger lever (101) and possessing a catch (155) which rests against the outside surface of the trigger lever (101) in the initial, safe position.

11. The ignitor plug according to claim 1, characterized by the fact that the latch (150) is urged towards the release position by a spring (170) mounted on its axis.

12. The ignitor plug according to claim 1, characterized by the fact that the latch (150) comprises two generally orthogonal branches (152, 154) one being substantially parallel to the translation axis of the primary pyrotechnical module (105) and serving as an initial abutment therefor, and the other being substantially radial relative to said axis and cooperating with the trigger lever (101).

13. The ignitor plug according to claim 1, characterized by the fact that the latch (150) has at least one branch (152) resting in the initial, safe position against a branch (126) of a pin (125).

14. The ignitor plug according to claim 1, characterized by the fact that the primary pyrotechnical module (105) is also held in its initial, safe position remote from the secondary pyrotechnical module (117) by a clip (102) which interferes with the body (104) and which is adapted to be withdrawn during ejection of the trigger lever (101).

15. The ignitor plug according to claim 1, characterized by the fact that the primary pyrotechnical module carries at least one delay element (109).

16. The ignitor plug according to claim 1, characterized by the tact that the primary pyrotechnical module (105) includes a pellet (12*a*) suitable for co-operating with a ring (115) of the secondary pyrotechnical module (117) to form a screen by becoming fixed together in the event of the primary pyrotechnical module (105) being excited in untimely manner while in the storage position.

17. The ignitor plug according to claim 1, characterized by the fact that said plug includes a pin (125) having a setback (127) such that the pin (125) cannot be withdrawn unless the trigger lever (101) has been pressed down.

18. The ignitor plug according to claim 1, characterized by the fact that said plug includes complementary shape means (bib, 156) defined between the latch (150) and the trigger lever (101) suitable for preventing the latch (150) from moving after removal of a pin (125) without the trigger lever (101) being manipulated.

19. The ignitor plug according to claim 18, characterized by the fact that the complementary shape means comprise a stud (156) secured to the end of a branch (154) of the latch (150) and suitable for penetrating into a complementary bore (bib) formed in the trigger lever (101).

20. The ignitor plug according to claim 1, characterized by the fact that said plug includes viscoelastic material (190) of hardness that increases with increasing speed of application of force thereto, said material being interposed between the trigger lever (101) and the body of the device.

21. The ignitor plug according to claim 5, characterized by the fact that one of the means for blocking the latch (150) is formed by the trigger lever (101).

22. The ignitor plug according to claim 5, characterized by the fact that one of the means for blocking the trigger lever (101) is formed by a pin (125).

23. The ignitor plug according to claim 5, characterized by the fact that the latch (150) is formed by a pivoting element having a branch (154) in engagement with the trigger lever (101) in the storage position.

24. The ignitor plug according to claim 5, characterized by the fact that the latch (150) is generally L-shaped, having two branches (152, 154), which branches co-operate respectively with the primary pyrotechnical module (105) to serve as an abutment therefore, and with the trigger lever (101).

25. The ignitor plug according to claim 5, characterized by the fact that the latch (150) has a branch (154) passing through a passage (101*a*) formed in the trigger lever (101) and possessing a catch (155) which rests against the outside surface of the trigger lever (101) in the initial, safe position.

26. The ignitor plug according to claim 5, characterized by the fact that the latch (150) is urged towards the release position by a spring (170) mounted on its axis.

27. The ignitor plug according to claim 5, characterized by the fact that the latch (150) comprises two generally orthogonal branches (152, 154) one being substantially parallel to the translation axis of the primary pyrotechnical module (105) and serving as an initial abutment therefor, and the other being substantially radial relative to said axis and cooperating with the trigger lever (101).

28. The ignitor plug according to claim 5, characterized by the fact that the latch (150) has at least one branch (152) resting in the initial, safe position against a branch (126) of a pin (125).

29. The ignitor plug according to claim 5, characterized by the fact that the primary pyrotechnical module (105) is also held in its initial, safe position remote from the secondary pyrotechnical module (117) by a clip (102) which interferes with the body (104) and which is adapted to be withdrawn during ejection of the trigger lever (101).

30. The ignitor plug according to claim 5, characterized by the fact that the primary pyrotechnical module carries at least one delay element (109).

31. The ignitor plug according to claim 5, characterized by the tact that the primary pyrotechnical module (105) includes a pellet (12*a*) suitable for co-operating with a ring (115) of the secondary pyrotechnical module (117) to form a screen by becoming fixed together in the event of the primary pyrotechnical module (105) being excited in untimely manner while in the storage position.

32. The ignitor plug according to claim 5, characterized by the fact that said plug includes a pin (125) having a setback (127) such that the pin (125) cannot be withdrawn unless the trigger lever (101) has been pressed down.

33. The ignitor plug according to claim 5, characterized by the fact that said plug includes complementary shape means (bib, 156) defined between the latch (150) and the trigger lever (101) suitable for preventing the latch (150) from moving after removal of a pin (125) without the trigger lever (101) being manipulated.

34. The ignitor plug according to claim 33, characterized by the fact that the complementary shape means comprise a stud (156) secured to the end of a branch (154) of the latch (150) and suitable for penetrating into a complementary bore (bib) formed in the trigger lever (101).

35. The ignitor plug according to claim 5, characterized by the fact that said plug includes viscoelastic material (190) of hardness that increases with increasing speed of application of force thereto, said material being interposed between the trigger lever (101) and the body of the device.

* * * * *